US005273207A

United States Patent [19]

Johnson

[11] Patent Number: 5,273,207

[45] Date of Patent: Dec. 28, 1993

[54] DELIVERED MAIL INDICATOR SYSTEM

[76] Inventor: Stephen C. Johnson, 815 Crystal Springs Rd., Grand Rapids, Minn. 55744

[21] Appl. No.: 987,205

[22] Filed: Dec. 8, 1992

[51] Int. Cl.[5] ..... B65D 91/00

[52] U.S. Cl. ..... 232/35

[58] Field of Search ..... 232/34, 35, 36, 37, 232/17

[56] References Cited

U.S. PATENT DOCUMENTS

| | | | |
|---|---|---|---|
| 1,370,196 | 3/1921 | Davis | 232/34 |
| 2,654,534 | 10/1953 | Van Meter | 232/34 |
| 2,843,316 | 7/1958 | Auger | 232/34 |
| 3,338,511 | 8/1967 | Cvar | 232/35 |
| 3,490,411 | 1/1970 | Poindexter | 232/34 |
| 3,586,235 | 6/1971 | Clemmons | 232/35 |
| 3,596,631 | 8/1971 | Sutton | 116/132 |
| 3,620,443 | 11/1971 | Sturtz | 232/35 |
| 3,623,655 | 11/1971 | Tleszen | 232/35 |
| 3,866,823 | 2/1975 | Grayson | 232/35 |
| 3,891,139 | 6/1975 | Redling | 232/35 |
| 4,000,847 | 1/1977 | Duis | 232/35 |
| 4,018,379 | 4/1977 | Carter | 232/35 |
| 4,793,552 | 12/1988 | Revels | 232/34 |
| 5,076,337 | 12/1991 | Reuter | 160/35 |

*Primary Examiner*—Peter M. Cuomo
*Assistant Examiner*—Flemming Saether
*Attorney, Agent, or Firm*—Hugh D. Jaeger

[57] ABSTRACT

Delivered mail indicator system for indicating when a mailbox door has been opened for the deposit of mail by the mailperson. A fluorescent or reflective lip is engaged in between the two latches of a mailbox, and when the mailbox door is opened, the lip springs upwardly and outwardly. When the mailbox door is closed, the lip or flag of the indicator engages against an upper latch handle, indicating that mail has been delivered. The delivered mail indicator is made of a suitable polymer with a flag appropriately colored for ease of visualization for indicating that mail has been delivered.

16 Claims, 2 Drawing Sheets

FIG. 1
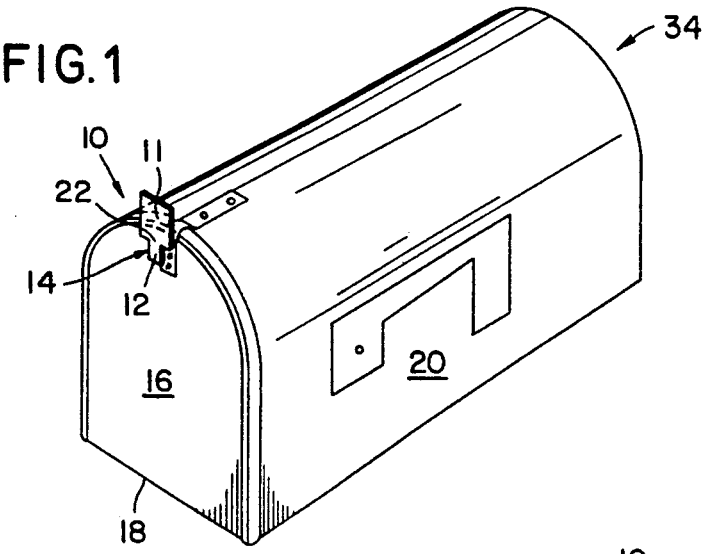
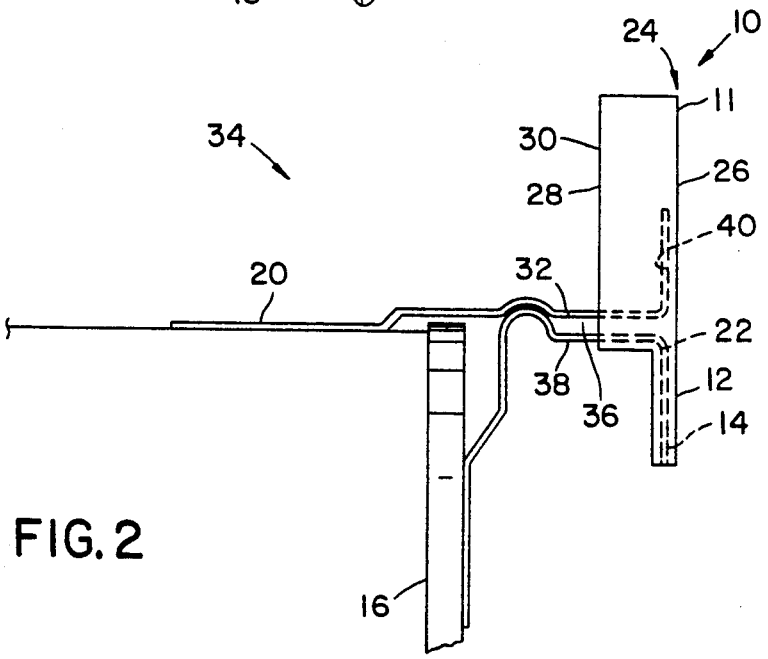
FIG. 2
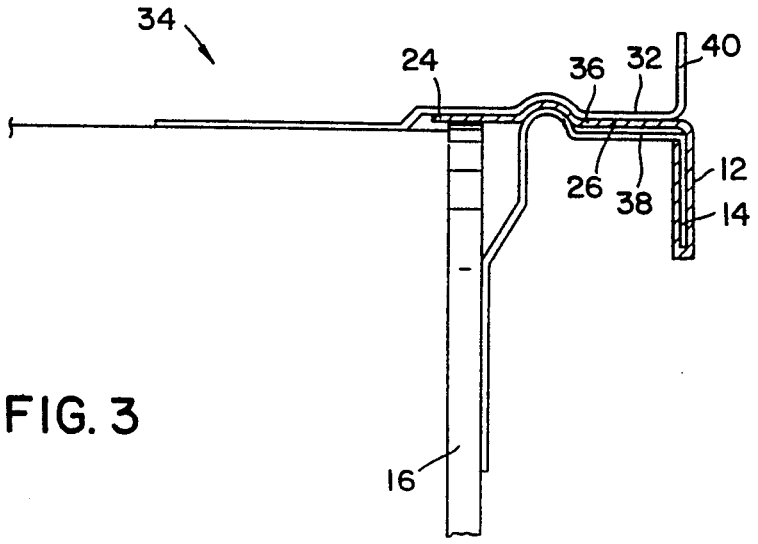
FIG. 3

FIG. 4
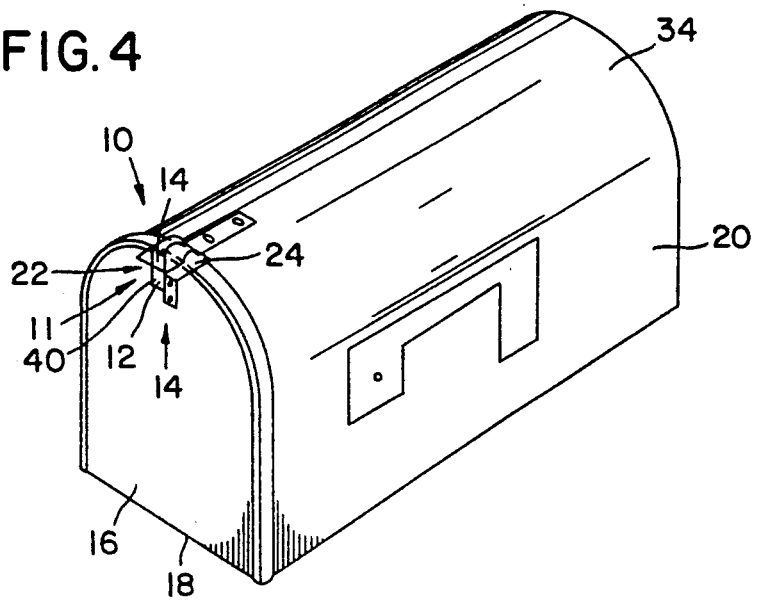
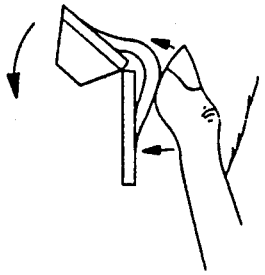
FIG. 5
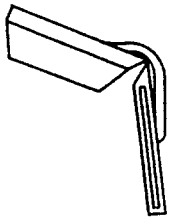
FIG. 6
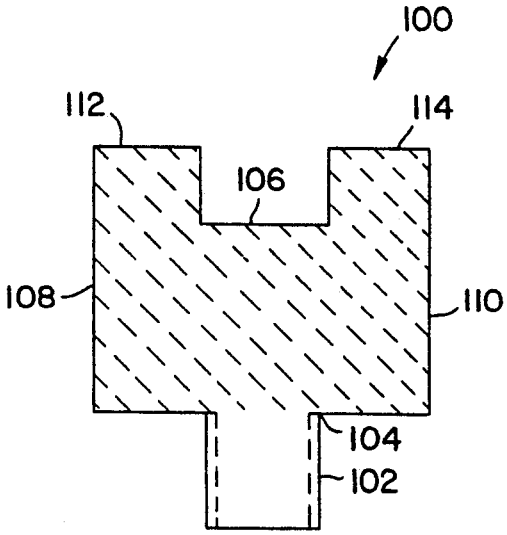
FIG. 7

DELIVERED MAIL INDICATOR SYSTEM

BACKGROUND OF THE INVENTION

1. Field of the Invention

The present invention pertains to mailboxes, and more importantly, pertains to a delivered mail indicator system for engagement on a lower latch of a mailbox.

2. Description of the Prior Art

Prior art indicators for indicating delivered mail have been usually complex devices having numerous components. Representative prior art patents having delivered mail indicators include the following patents:

Clemmons, U.S. Pat. No. 3,586,235
Sutton, U.S. Pat. No. 3,596,631
Tieszen, U.S. Pat. No. 3,623,655
Grayson, U.S. Pat. No. 3,866,823
Redling, U.S. Pat. No. 3,891,139
Duis, U.S. Pat. No. 4,000,847
Armstrong, U.S. Pat. No. 5,060,854
Reuter, U.S. Pat. No. 5,076,337

The present invention overcomes the disadvantages of the prior art by providing a delivered mail indicator system which is easily installed and easily viewable.

SUMMARY OF THE INVENTION

The general purpose of the present invention is a delivered mail indicator system which installs easily in a lower mailbox latch, and engages between the mailbox latches or against the upper mailbox latch.

According to one embodiment of the present invention, there is provided a delivered mail indicator system including a lower tube for engaging on the lower latch, a living hinge, and a lip for engaging between the lower latch and upper latch. When the mailbox door is opened, the lip springs outwardly and upwardly to engage against the upper latch, indicating that mail has been delivered. The tube and latch can be any color or different colors, such as the tube can be a neutral color, such as clear, and the lip can be a different color, such as fluorescent, to be easily visible from a long distance.

The delivered mail indicator has certain elastic qualities, including ease of installation. The indicator can be made of an ultraviolet resistant polymer or a very soft metal. The delivered mail indicator is set by a slight pressure and folding down of the lip or flag, and secures between the door latches, which then pops up or flies up when the mailbox door is opened. This indicator provides indication to an individual that mail has been delivered, and eliminates inconvenience of always checking the mailbox. The delivered mail indicator provides for ease of operation, and longevity of the product. The delivered mail indicator also eliminates checking the mailbox two, or three or more times, and not having to walk through snow, rain, cold, or crossing the street unnecessarily, as the indicator informs one that the mailbox door has been opened and closed. The indicator is very effective, meets a specific need, is very helpful, improves the comfort of the handle, and also provides installation qualities of the handle, besides looking aesthetically pleasing.

The delivered mail indicator with a living hinge of a polymer material provides a spring-type quality. The delivered mail indicator slides onto the mailbox door latch, and when opened, extends above the mailbox door latch. The delivered mail indicator is easy to reset by sliding the indicator between the door latches. The delivered mail indicator has application ease, visibility, and requires no maintenance, besides being aesthetically pleasing.

Significant aspects and features of the present invention include a delivered mailbox indicator system which can be utilized by anyone, is easily installed on the mailbox, is easily visible from long distances, and could be used by anyone of any age.

Having thus described the embodiments of the present invention, it is a principal object hereof to provide a delivered mail indicator system for indicating when mail has been delivered to a mailbox.

One object of the present invention is a delivered mail indicator which is easily visible from a long distance.

Another object of the present invention is a delivered mail indicator which is easily installed on a mailbox, especially the standard size mailbox.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein:

FIG. 1 illustrates a perspective view of a mailbox with a delivered mail indicator system prior to engagement;

FIG. 2 illustrates a side view of the delivered mail indicator system;

FIG. 3 illustrates a side view of the delivered mail indicator system and includes a cross-sectional view of the indicator;

FIG. 4 illustrates a perspective view of a mailbox with a delivered mail indicator system after engagement;

FIG. 5 illustrates a plan view of the setting of the delivered mail indicator;

FIG. 6 illustrates a plan view of the movement about the living hinge; and,

FIG. 7 illustrates a plan view of an alternative embodiment.

DETAILED DESCRIPTION OF THE PREFERRED EMBODIMENTS

FIG. 1 illustrates a perspective view of a mailbox 34 with a delivered mail indicator system 10 prior to engagement, including an indicator 11, a lower tubular member 12, which engages over a lower latch handle 14 of a mailbox door 16. The mailbox door 16 is hinged at 18 to a mailbox enclosure 20.

FIG. 2 illustrates a side view of the delivered mail indicator system 10 prior to being armed to indicate opening of the door 16 where all numerals correspond to those elements previously described. At the mid-portion of the indicator 11 is a living hinge 22. A lip or flag 24 with a middle section 26, a left side 28, and a right side 30 extend upwardly. The middle section 26 of the lip 24 engages between the space 36 between the horizontal lower latch portion 38 and the horizontal upper latch portion 32 as illustrated in FIGS. 3 and 4.

FIG. 3 illustrates a side view of the delivered mail indicator system including a cross-sectional view of the indicator 11 where all numerals correspond to those elements previously described. The middle section 26 of the lip 24 engages the space 36 between the horizontal lower latch portion 38 and the horizontal upper latch portion 32.

MODE OF OPERATION

FIG. 4 illustrates a perspective view of a mailbox 34 with a delivered mail indicator system 10 after engagement. When the mailbox door 16 is opened, the elasticity of the indicator 10 about the living hinge 22, causes the lip or flag 24 to disengage between the two latch handles 14 and 40, and extend upwardly into an indicating position about the upper latch handle 40 as illustrated in FIGS. 1 and 2. This indicates that the mailbox door 16 has been opened, and presumably opened by a mailperson to place mail into the mailbox body 20. The upwardly extending lip or flag 24 about the upper latch handle 40 is an indication that the mailbox door 16 has been opened, and presumably that mail has been delivered. In the alternative, the delivered mail indicator 11 can be installed on the top latch handle and work in reverse. The delivered mail indicator could also be made out of a soft metal.

FIG. 5 illustrates a plan view of the setting of the delivered mail indicator 10 where all numerals correspond to those elements previously described.

FIG. 6 illustrates a plan view of the movement about the living hinge 22 where all numerals correspond to those elements previously described.

DESCRIPTION OF AN ALTERNATIVE EMBODIMENT

FIG. 7 illustrates a plan view of an alternative embodiment 100 of the present invention, including a tubular member 102, a living hinge 104, a middle section 106, a left side 108, a right side 110, a left extending member 112 and a right extending member 114. The device can be made out of a polymer-type tubing, slit and cut appropriately. The tubular member can be tan, neutral or white, and the lip or flag member can be colored such as with a fluorescent or reflective material.

Various modifications can be made to the present invention without departing from the apparent scope hereof.

I claim:

1. A delivered mail indicator system comprising;

a. a lower tubular body for engagement over a lower latch of a mailbox door;

b. a living hinge attached to one end of said tubular body; and, c. a lip attached to said living hinge for engagement between said lower latch and an upper latch of a mailbox enclosure, whereby said lip engages between said two latches in a first position and said lip engages up against the upper latch of the mailbox enclosure in a second position.

2. The delivered mail indicator system of claim 1 wherein said indicator is a polymer material.

3. The delivered mail indicator system of claim 1 wherein said lip is of a fluorescent color.

4. The delivered mail indicator system of claim 1 wherein said lip is of a reflective material.

5. The delivered mail indicator system of claim 1 wherein said lip includes a left side and a right side providing a larger surface area.

6. The delivered mail indicator system of claim 1 wherein said lip includes extender members on a left side and on a right side.

7. In combination, a mailbox and a delivered mail indicator comprising;

a. a mailbox including a mailbox enclosure, a hinged door, an upper latch on the mailbox enclosure, and a lower latch on the mailbox door; and, b. a delivered mail indicator including a tubular member for engagement over said lower latch, a living hinge at one end of said tubular member, and a lip affixed to said living hinge for engagement between said latches in a first position or engagement over said upper latch in a second position.

8. The delivered mail indicator system of claim 7 wherein said indicator is a polymer material.

9. The delivered mail indicator system of claim 7 wherein said lip is of a fluorescent color.

10. The delivered mail indicator system of claim 7 wherein said lip is of a reflective material.

11. The delivered mail indicator system of claim 7 wherein said lip includes a left side and a right side providing a larger surface area.

12. The delivered mail indicator system of claim 2 wherein said lip includes extender members on a left side and on a right side.

13. The process for indicating delivered mail comprising the steps of:

a. providing a indicator member comprising a tubular member with a lip pivoted thereto by a living hinge b. engaging the tubular member over a lower latch handle of a mailbox door, wherein the mailbox door is hinged to a mailbox enclosure;

c. engaging the lip between the lower latch and an upper latch of the mailbox enclosure;

d. opening the mailbox door;

e. delivering mail to the mailbox;

f. said lip of said mailbox indicator springing outwardly about the living hinge;

g. closing said mailbox door; and, h. said lip engages against said upper latch handle, whereby said engaged lip of said upper latch handle indicates that the mailbox door has been opened and closed.

14. The delivered mail indicator system of claim 13 wherein said indicator is a polymer material.

15. The delivered mail indicator system of claim 13 wherein said lip is of a fluorescent color.

16. The delivered mail indicator system of claim 13 wherein said lip is of a reflective material.

* * * * *